US007744753B2

(12) United States Patent
Towler

(10) Patent No.: US 7,744,753 B2
(45) Date of Patent: Jun. 29, 2010

(54) COKING APPARATUS AND PROCESS FOR OIL-CONTAINING SOLIDS

(75) Inventor: Gavin P. Towler, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 241 days.

(21) Appl. No.: 11/751,987

(22) Filed: May 22, 2007

(65) Prior Publication Data

US 2008/0290000 A1 Nov. 27, 2008

(51) Int. Cl.
*C10G 1/06* (2006.01)

(52) U.S. Cl. ..... 208/410; 208/113; 208/126; 208/127; 208/409; 208/411; 208/50; 208/52 R; 208/52 CT; 208/53

(58) Field of Classification Search ..... 208/50, 208/52 R, 52 CT, 53, 113, 126–127, 409–411, 208/417; 422/196
See application file for complete search history.

(56) References Cited

U.S. PATENT DOCUMENTS

| | | | | |
|---|---|---|---|---|
| 3,623,972 | A | 11/1971 | Bennett | |
| 3,703,052 | A | 11/1972 | Linden | |
| 3,840,353 | A | 10/1974 | Squires | |
| 3,922,215 | A | 11/1975 | Linden et al. | |
| 4,010,092 | A | 3/1977 | Deering | |
| 4,137,053 | A | 1/1979 | Mitchell et al. | |
| 4,193,862 | A | 3/1980 | Ban et al. | |
| 4,376,033 | A | 3/1983 | Calderon | |
| 4,399,314 | A | 8/1983 | Child | |
| 4,412,910 | A | 11/1983 | Archer et al. | |
| 4,446,001 | A | 5/1984 | Deering | |
| 4,448,668 | A | 5/1984 | Deering | |
| 4,560,547 | A | 12/1985 | Schora et al. | |
| 4,564,437 | A | 1/1986 | Deering | |
| 4,725,350 | A | 2/1988 | Smith | |
| 4,804,459 | A * | 2/1989 | Bartholic et al. | 208/253 |
| 5,156,734 | A | 10/1992 | Bowles | |
| 5,322,617 | A | 6/1994 | De Bruijn | |
| 6,709,573 | B2 | 3/2004 | Smith | |

FOREIGN PATENT DOCUMENTS

| | | |
|---|---|---|
| EP | 0488473 B1 | 7/1994 |

* cited by examiner

*Primary Examiner*—Robert J Hill, Jr.
*Assistant Examiner*—Brian McCaig
(74) *Attorney, Agent, or Firm*—Kenneth Joung

(57) ABSTRACT

A process for upgrading unconventional or heavy oils such as, tar sands, shale oil, or bitumen. This process may include a coking scheme in which oil-containing solids, of suitable size, are fed directly into the riser of an FCC unit. Contacting a hot stream of solids causes vaporization and produces a gaseous product stream. The gaseous product may be separated out in a separating vessel and coked or unconverted oil-containing solids may be transferred to a gasifier for combustion at high temperatures to remove the coke and residual oil. Syngas from the gasifier may be converted to hydrogen using a water gas shift reaction. The hydrogen may be used for hydroprocessing.

16 Claims, 2 Drawing Sheets

COKING APPARATUS AND PROCESS FOR OIL-CONTAINING SOLIDS

BACKGROUND OF THE INVENTION

This invention is directed to a process of upgrading unconventional or heavy oils such as tar sands, shale oil, or bitumen. More specifically, the invention relates to a coking scheme where oil-containing solids are fed directly into a fluid catalytic cracking (FCC) apparatus.

DESCRIPTION OF THE PRIOR ART

Obtaining oil and gas products from oil-containing solids, such as tar sands, shale oil, and bitumen, has been the subject of many methods. Problematic for the methods is that vast amounts of solids must be processed in order to yield a relatively small amount of oil and gas product. For example, shale oil usually contains only about 20 to 80 gallons of oil per ton, of which only a limited proportion can be recovered as product oil or gas. Processes and apparatus for educing oil and gas products from oil-containing solids have been inefficient and required costly amounts of energy to be introduced into the process.

An FCC apparatus has the basic components of a riser, a reactor for disengaging spent catalyst from product vapors, and a regenerator. Under FCC conditions, hydrocarbon feed contacts a catalyst in the riser and is cracked into a product stream containing lighter hydrocarbons. Catalyst and feed are transported up the riser by the expansion of the gases that result from the vaporization of the hydrocarbons, as well as by fluidizing mediums. Contact with the catalyst causes the hydrocarbon feed to be cracked into lower molecular weight, lighter, gaseous products. Coke accumulates on the catalyst particles as a result of the cracking reaction. The coke is burned off the catalyst through high temperature exposure in a regenerator. The catalyst becomes essentially coke-free and is recycled from the regenerator into the riser.

In the coking process, a purely thermal destruction of a hydrocarbon yields a solid residue and volatile cracked products. No catalyst is used during the coking process. Distillation of petroleum and petroleum products leave some residue that upon further heating decomposes to release additional distillable material and a carbon residue.

The most common coking process is delayed coking. In delayed coking, the feed is heated and charged to a drum where the residual oil dwells typically for about 12 hours and solidifies while the liquid products are recovered and fed to a fractionation column. The coke is then cooled with water and broken apart with high pressure water and dumped in chunk form.

In fluidized coking, the feed is sprayed into a circulating fluidized stream of coke particles and the operation is continuous with a slipstream of the sand-like particles withdrawn continuously from a tap in the coking chamber. The heat necessary to accomplish the thermal decomposition to coke is partly supplied by burning some of the coke in a combustor, from which the hot particles are returned to the contacting zone.

Processes and apparatus for educing oil and gas products from oil-containing solids have been inefficient. The amounts of energy to be introduced into the process result in high costs, rendering most commercially unviable. Thus, there is a need for a more efficient means for utilizing the hydrocarbon in oil-containing solids.

SUMMARY OF THE INVENTION

In accordance with one aspect of the invention, a process for upgrading unconventional or heavy oils such as, tar sands, shale oil, or bitumen may include a coking scheme in which oil-containing solids, of suitable size, are fed directly into the riser of an FCC unit. Contacting a hot stream of solids causes vaporization and produces a gaseous product streams. The gaseous product may be separated out in a separating vessel and coked or unconverted oil-containing solids may be transferred to a gasifier for combustion at high temperatures to remove the coke and residual oil.

Syngas from the gasifier may be converted to hydrogen using a water gas shift reaction. The hydrogen may be used for the hydroprocessing of oil-containing solids and other upgrading processes to produce a synthetic crude oil blend.

DETAILED DESCRIPTION OF THE DRAWINGS

Figure 1:
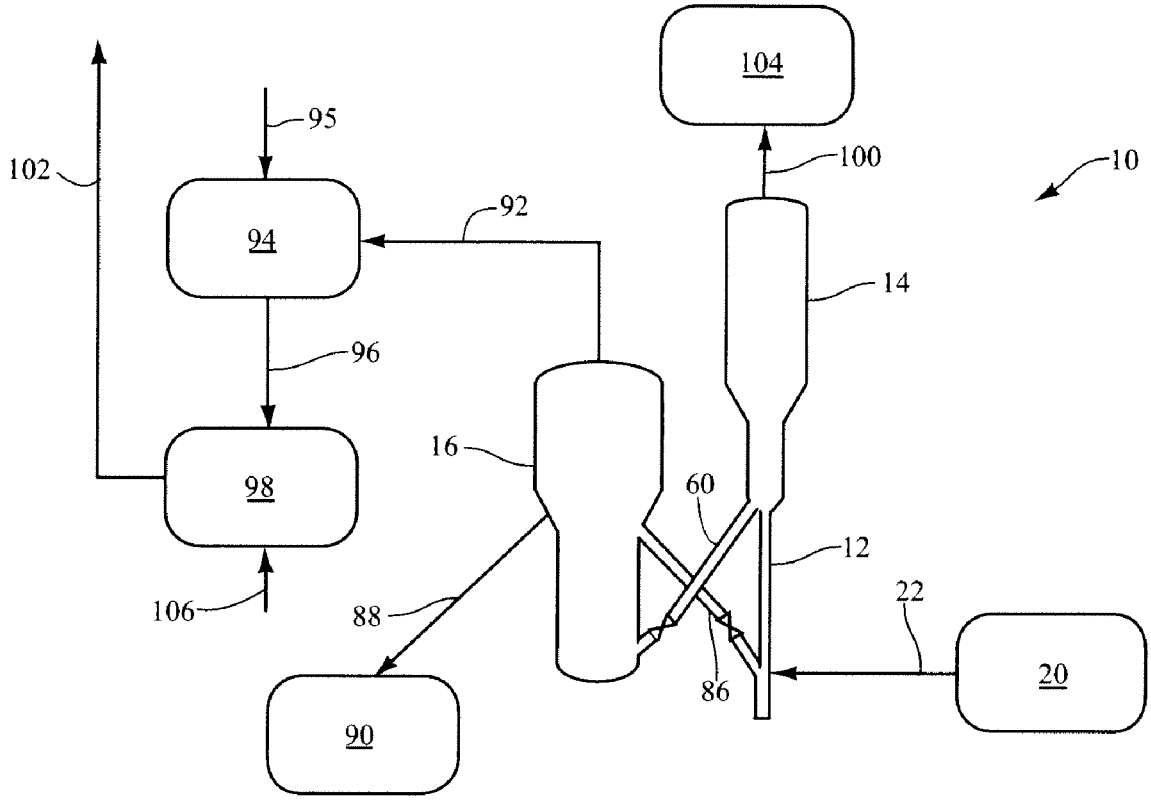
FIG. 1 is a schematic of a coking upgrading process for oil-containing solids.

A process for upgrading unconventional or heavy oils such as, tar sands, shale oil, or bitumen may include a coking scheme 10, as shown in FIG. 1. Coking scheme 10 may comprise providing oil-containing solids suitable for introduction into a riser 12, injecting a fluidizing medium into the riser 12, feeding oil-containing solids into the riser 12, contacting oil-containing solids with a hot stream of solids, cracking and vaporizing hydrocarbons in oil-containing solids, separating gaseous products from said oil-containing solids in a separator vessel 14, transferring coked oil-containing solids to a gasifier 16, introducing a stream of oxygen-containing gas, comprising oxygen, carbon dioxide and water vapor, into the gasifier 16, and recovering syngas from the gasifier 16.

As shown in FIG. 1, a coking process may incorporate a grinding device 20, or other means, that reduces the diameter of oil-containing solids to be suitable for introducing into a riser 12. The necessity of grinding depends on the original size of the oil-containing solids. Some material may have oil-containing solids sized suitably for introducing into a riser and some may be close to a suitable size, requiring little grinding, whereas other materials may require considerable grinding, or other means, to reduce size. The preferred diameter of oil-containing solids may be between about 50 microns and about 1 mm, and even more preferably between about 200 and 300 microns. Oil-containing solids may be fed into a riser 12 through a solids line 22 or other suitable means.

Oil-containing solids may be tar sands, shale oil, bitumen, or other solid material containing oil. These materials are usually mined out of the earth and therefore regularly have earth, clay, shale, sand and other minerals mixed into their quantities. Earth, contaminants, and other materials may be a substantial percentage by weight of the oil-containing solids.

Figure 2:
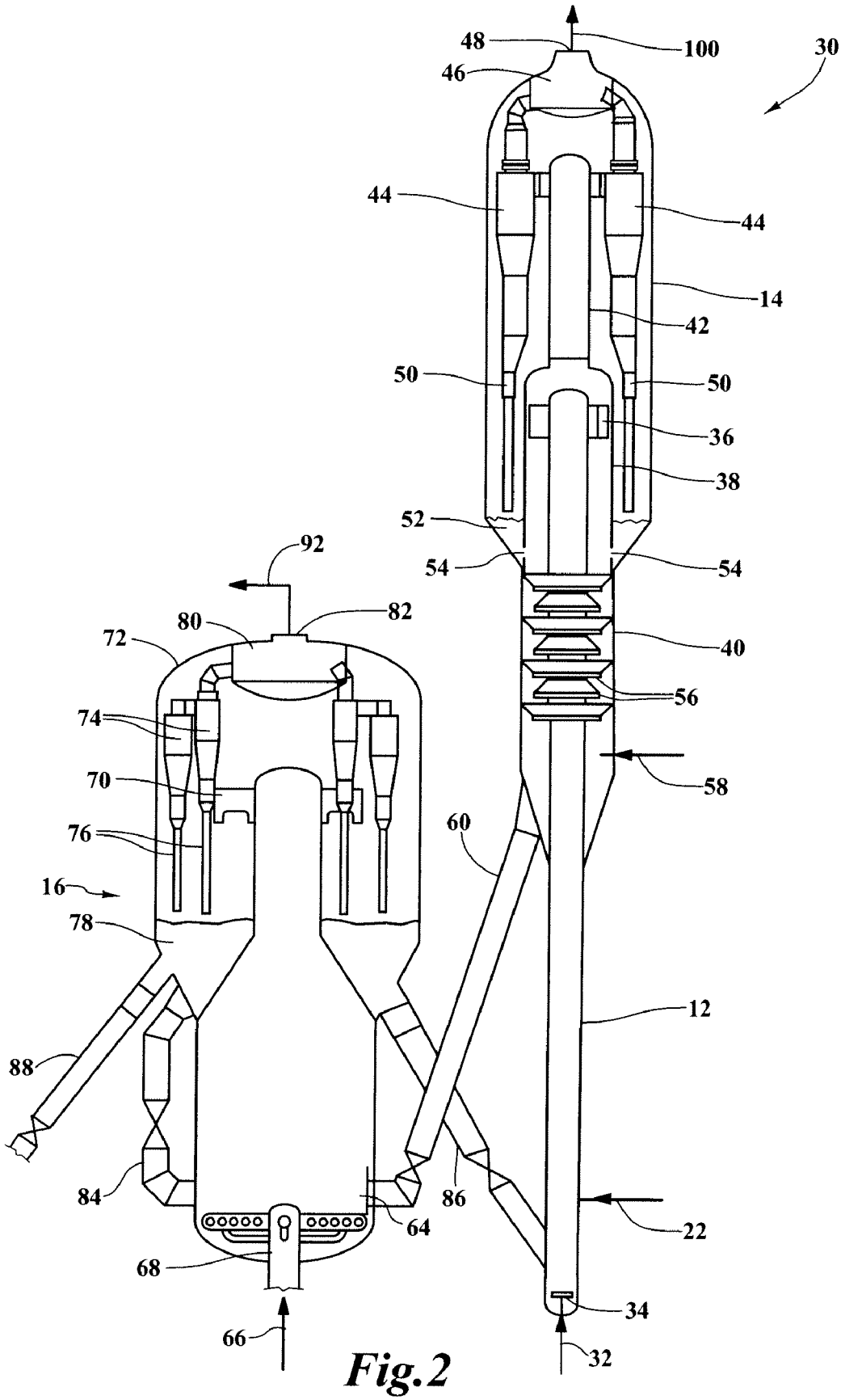
FIG. 2 is a cross-sectional elevation view of the FCC apparatus in FIG. 1.

As shown in FIG. 2, an FCC-type apparatus 30 may be used in this process. A fluidizing medium, such as steam, may travel to riser 12 through a steam line 32 and injected into riser 12 through a steam distributor 34. The fluidizing medium is injected at a rate sufficient to transport a hot stream of solids upwardly in the riser 12. Oil-containing solids are fed into riser 12 and contact the hot stream of solids, resulting in the formation of vaporized lighter products. The hot stream of solids, oil-containing solids, and gaseous products travel up riser 12 and enter separator vessel 14, which may be the reactor of the FCC unit, where gaseous products are separated out. The concentration of oil in the oil-containing solids entering the riser 12 may be greater than the oil-containing solids exiting said riser 12.

In the separator vessel 14, the oil-containing solids, much of which now have become laden with coke, and some of which is still unconverted, are separated from the gaseous products through various means. Arrangements of separators to quickly separate coked oil-containing solids from the gaseous products may be utilized. In particular, a swirl arm arrangement 36, provided at the end of the riser 12 in a separation chamber 38, may further enhance initial coked oil-containing solids and gaseous products separation by imparting a tangential velocity to the exiting coked oil-containing solids and gaseous products mixture. Coked oil-containing solids separated by the swirl arm arrangement 36 drops down into the stripping zone 40.

The gaseous products comprising hydrocarbons including gasoline and light olefins, and some coked oil-containing solids may exit the separation chamber 38 via a gas conduit 42. Cyclones 44 may remove much of the remaining coked oil-containing solids from the gaseous products. The gaseous products may enter into a vessel plenum 46 before exiting the separating vessel 14 through a product outlet 48.

Coked oil-containing solids separated by the cyclones 44 may return to the separation chamber 38 through vessel diplegs 50 into a coked dense bed 52 where coked oil-containing solids pass through chamber openings 54 and enter the stripping zone 40. The stripping zone 40 removes adsorbed hydrocarbons from the surface of the oil-containing solids by counter-current contact with steam over optional baffles 56. Steam may enter the stripping zone 40 through a line 58. A transfer conduit 60 transfers coked oil-containing solids to a gasifier 16, which may be a bubbling bed regenerator or a combustor-style regenerator.

FIG. 2 depicts a gasifier 16 that may be a combustor-style regenerator. Coked oil-containing solids enter the gasifier through a gasifier inlet 64. A gas line 66 supplies oxygen containing gas to a gasifier distributor 68. A fluidized bed or fast fluidized transport system may be created in the bottom of the gasifier 16 with the oil-containing solids and oxygen containing gas. Coke deposits on the oil-containing solids combust in the gasifier 16. Temperatures in the gasifier 16 may be between about 650° C. and about 1200° C., preferably between about 700° C. and about 900° C., even more preferably between about 700° C. and about 815° C. The combustion is carried out under partial oxidation conditions to yield a syngas, comprising carbon dioxide, carbon monoxide, hydrogen and water vapor, and solids that are substantially free of carbon deposits. The use of a gasifier 16 as the solids regenerator reactor may result in the formation of a substantial amount of syngas.

Syngas, and some solids, may travel up the gasifier 16 and pass through a disengager 70 into an upper chamber 72 of the gasifier 16. Syngas and trace amounts of solids may enter gasifier cyclones 74 where solids may exit through diplegs 76 into a gasifier dense bed 78. Syngas may enter into a gasifier plenum 80 before exiting the gasifier though an outlet 82. A gasifier 16 may have a recirculation conduit 84, as shown in FIG. 2, that may transport some solids to the bottom of the gasifier 16. The gasifier 16 may have a recycle standpipe 86 in communication with the riser 12. The solids, which are hot from combustion of carbon deposits, may form part or all of the stream of hot solids in the riser 12 that contacts the oil-containing solids in the riser 12. Solids may be released from the gasifier 16 through a waste duct 88. Solids passing through the waste duct 88 may leave the process for other purposes or as waste solids 90. Additional solids may be added to the regenerator, for example, FCC catalyst or additives.

As shown in FIG. 1, syngas exiting through the outlet 82 of the gasifier 16 may travel through a syngas line 92 to be converted to hydrogen. Syngas conversion to hydrogen may be accomplished through a water gas shift reaction in reactor 94. Reactor 94 may comprise one or a series of shift reaction zones which exothermically react the carbon monoxide in the syngas from line 92 over a shift catalyst in the presence of water, preferably in excess, introduced from line 95 to produce carbon dioxide and hydrogen at a shift temperature of between about 180° C. to about 450° C. The shift catalyst may be selected from the group consisting of iron oxide, chromic oxide, cupric oxide or zinc oxide aid mixtures thereof. Other types of low temperature shift catalysts may include copper supported on other transition metal oxides such as zirconia, zinc supported on transition metal oxides or refractory supports such as silica or alumina, supported platinum, supported rhenium, supported palladium, supported rhodium, and supported gold. The shift reaction is an exothermic reaction. Heat may be removed by direct quench with water which may serve as reactant, by indirect heat exchange between product and feed water or by other methods. If preheated, the feed water stream in line 95 may have a temperature of about 100 to about 150° C. The shift effluent in a hydrogen line 96 may comprise less than about 0.5 mol-% carbon monoxide.

The product hydrogen from reactor 94 may travel through the hydrogen line 96 for use with other upgrading processes in reactor 98, such as hydroprocessing, of a separate hydrocarbon stream or even the FCC effluent stream from line 100, introduced through line 106 (the latter arrangement is not shown in the drawings). Hydroprocessing processes are carried out to react hydrogen with a hydrocarbon-containing mixture in the presence of a catalyst. The reaction is carried out at pressures in the range 700 to 21,000 kPa (gauge) and temperatures in the range 150 to 550° C. The hydroprocessing catalysts usually contain at least one metal chosen from the set nickel, iron, cobalt, molybdenum, vanadium, platinum, palladium and rhenium. The catalyst is disposed on a support material that is usually an alumina, an aluminosilicate, an aluminophosphate or a silicate. The space velocity based on liquid flow rate is usually in the range 0.2 $hr^{-1}$ to 4.0 $hr^{-1}$.

Optionally, gaseous hydrocarbon products from the separator vessel 14 may be directed from a product line 100 to a blending vessel 104 to be blended with a hydrocarbon stream, which may be from the upgrading process reactor 98 traveling in line 102 to blending vessel 104. Further processing may be performed on stream 100 before entering blending vessel 104, or material from blending vessel 104 may be subjected to further processing.

The combination of a cracking process, hydrogen formation and hydroprocessing allows for the production of lighter blending stocks that may be used either to make transportation fuels or blending with much greater volume of bitumen to generate a pumpable synthetic crude oil stream. This process and apparatus is therefore an attractive scheme for increasing the output of heavy oil or bitumen producing facilities.

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. A coking process, comprising:

grinding oil-containing solids to produce oil-containing solids suitable for introduction into a riser;

injecting a fluidizing medium into said riser;

feeding said oil-containing solids suitable for introduction into a riser directly into said riser;

contacting said directly-fed oil-containing solids with a hot stream of solids;

cracking a portion of the hydrocarbons from said directly-fed oil-containing solids;

separating gaseous products from said directly-fed oil-containing solids in a separator vessel;

transferring coked oil-containing solids into a gasifier;

introducing a stream of gas comprising oxygen-containing gases into said gasifier; and recovering syngas from said gasifier.

2. The process of claim 1, further comprising converting said syngas to hydrogen.

3. The process of claim 2, wherein said converting step is accomplished using a water gas shift reaction.

4. The process of claim 2, further comprising hydroprocessing a hydrocarbon using said hydrogen.

5. The process of claim 4, further comprising combining said gaseous products and said hydroprocessed hydrocarbon.

6. The process of claim 5, wherein said combining step produces a synthetic crude oil blend.

7. The process of claim 1, wherein the temperature within said gasifier is between about 650° C. and about 1200° C.

8. The process of claim 1, wherein the temperature within said gasifier is between about 700° C. and about 900° C.

9. The process of claim 1, wherein in said grinding step, said oil-containing solids comprises bitumen.

10. The process of claim 1, wherein in said grinding step, said oil-containing solids comprises tar sands.

11. The process of claim 1, wherein in said grinding step, said oil-containing solids comprises shale oil.

12. The process of claim 1, wherein said oil-containing solids have diameters between about 50 microns and about 1 mm.

13. The process of claim 1, wherein said hot stream of solids comprises recycled oil-containing solids from said gasifier.

14. The process of claim 1, wherein the concentration of oil in said oil-containing solids entering said riser is greater than the oil-containing solids exiting said riser.

15. A coking process, comprising:

grinding oil-containing solids to produce oil-containing solids suitable for introduction into a riser;

injecting a fluidizing medium into said riser;

feeding said oil-containing solids suitable for introduction into a riser directly into said riser;

contacting said directly-fed oil-containing solids with a hot stream of solids;

cracking a portion of the hydrocarbons from said directly-fed oil-containing solids;

separating gaseous products from said directly-fed oil-containing solids in a separator vessel;

transferring coked oil-containing solids into a gasifier;

introducing a stream of gas comprising oxygen-containing gases into said gasifier;

recovering syngas from said gasifier;

recycling a hot stream of solids from said gasifier to said riser;

converting said syngas to hydrogen using a water gas shift reaction;

hydroprocessing a hydrocarbon using said hydrogen; and wherein the concentration of oil in said oil-containing solids entering said riser is greater than in a hot stream of oil-containing solids exiting said riser.

16. The process of claim 15, further comprising blending said gaseous products and said hydroprocessed hydrocarbon to produce a synthetic crude oil blend.

* * * * *